US010461472B2

(12) United States Patent
Genta et al.

(10) Patent No.: US 10,461,472 B2
(45) Date of Patent: Oct. 29, 2019

(54) ELECTRICAL CONNECTOR

(71) Applicant: Tyco Electronics AMP Italia S.R.L., Turin (IT)

(72) Inventors: Alessandro Genta, Alpignano (IT); Demis Spincich, Turin (IT)

(73) Assignee: Tyco Electronics AMP Italia S.R.L., Turin (IT)

( * ) Notice: Subject to any disclaimer, the term of this patent is extended or adjusted under 35 U.S.C. 154(b) by 0 days.

(21) Appl. No.: 15/988,540

(22) Filed: May 24, 2018

(65) Prior Publication Data

US 2018/0342835 A1 Nov. 29, 2018

(30) Foreign Application Priority Data

May 25, 2017 (IT) ..... 102017000057099

(51) Int. Cl.
*H01R 13/639* (2006.01)
*H01R 13/627* (2006.01)
*H01R 13/641* (2006.01)

(52) U.S. Cl.
CPC ..... *H01R 13/639* (2013.01); *H01R 13/6277* (2013.01); *H01R 13/641* (2013.01)

(58) Field of Classification Search
CPC . H01R 13/639; H01R 13/6277; H01R 13/641
See application file for complete search history.

(56) References Cited

U.S. PATENT DOCUMENTS 4,179,179 A * 12/1979 Lowden ..... H01R 27/00 439/278
5,607,324 A * 3/1997 Saur ..... H01R 13/745 248/27.3
5,823,813 A * 10/1998 Dye ..... H01R 13/6277 439/347
5,941,730 A * 8/1999 Uchiyama ..... F02M 37/10 439/550
6,379,162 B1 4/2002 Raypole et al.
2010/0093205 A1* 4/2010 Stone ..... H01R 13/5219 439/352
2010/0136809 A1* 6/2010 Andres ..... G02B 6/389 439/133

(Continued)

OTHER PUBLICATIONS

Italian Search Report, dated Feb. 22, 2018, 28 pages.

*Primary Examiner* — Truc T Nguyen
(74) *Attorney, Agent, or Firm* — Barley Snyder

(57) ABSTRACT

An electrical connector comprises a first connector, a second connector matable with the first connector, an elastic clip mounted on the first connector and movable between an engagement position and a disengagement position, and a safety locking member slidably mounted on the first connector and movable between a pre-locking position and a locking position. The elastic clip is coupled to the second connector in the engagement position to keep the second connector mated with the first connector. The elastic clip enables decoupling of the first connector and the second connector in the disengagement position. The safety locking member contacts the elastic clip in the locking position and prevents movement of the elastic clip from the engagement position toward the disengagement position.

22 Claims, 5 Drawing Sheets

(56) References Cited

U.S. PATENT DOCUMENTS

| | | | | |
|---|---|---|---|---|
| 2013/0217252 | A1* | 8/2013 | Carden | H01R 13/6275 439/304 |
| 2015/0311633 | A1* | 10/2015 | Miklinski | H01R 13/6273 439/345 |
| 2018/0306363 | A1* | 10/2018 | Oberdorfer | F16L 37/088 |

* cited by examiner

ELECTRICAL CONNECTOR

CROSS-REFERENCE TO RELATED APPLICATION

This application claims the benefit of the filing date under 35 U.S.C. § 119(a)-(d) of Italian Patent Application No. 102017000057099, filed on May 25, 2017.

FIELD OF THE INVENTION

The present invention relates to an electrical connector and, more particularly, to an electrical connector having an elastic clip for keeping a first connector of the electrical connector coupled to a second connector of the electrical connector.

BACKGROUND

Known electrical connectors include a first connector and a second connector matable with one another. The first connector and the second connector each have electrical terminals and bodies which can be coupled to one another. An elastic clip is attached to the first connector and is movable between an engagement position, in which the elastic clip is coupled to the second connector to keep it coupled to the first connector, and a disengagement position in which the elastic clip enables decoupling of the first connector and the second connector. In known electrical connectors, however, it is difficult to ensure that the elastic clip remains coupled with the second connector, and the first connector can thereby be unintentionally decoupled from the second connector.

SUMMARY

An electrical connector comprises a first connector, a second connector matable with the first connector, an elastic clip mounted on the first connector and movable between an engagement position and a disengagement position, and a safety locking member slidably mounted on the first connector and movable between a pre-locking position and a locking position. The elastic clip is coupled to the second connector in the engagement position to keep the second connector mated with the first connector. The elastic clip enables decoupling of the first connector and the second connector in the disengagement position. The safety locking member contacts the elastic clip in the locking position and prevents movement of the elastic clip from the engagement position toward the disengagement position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
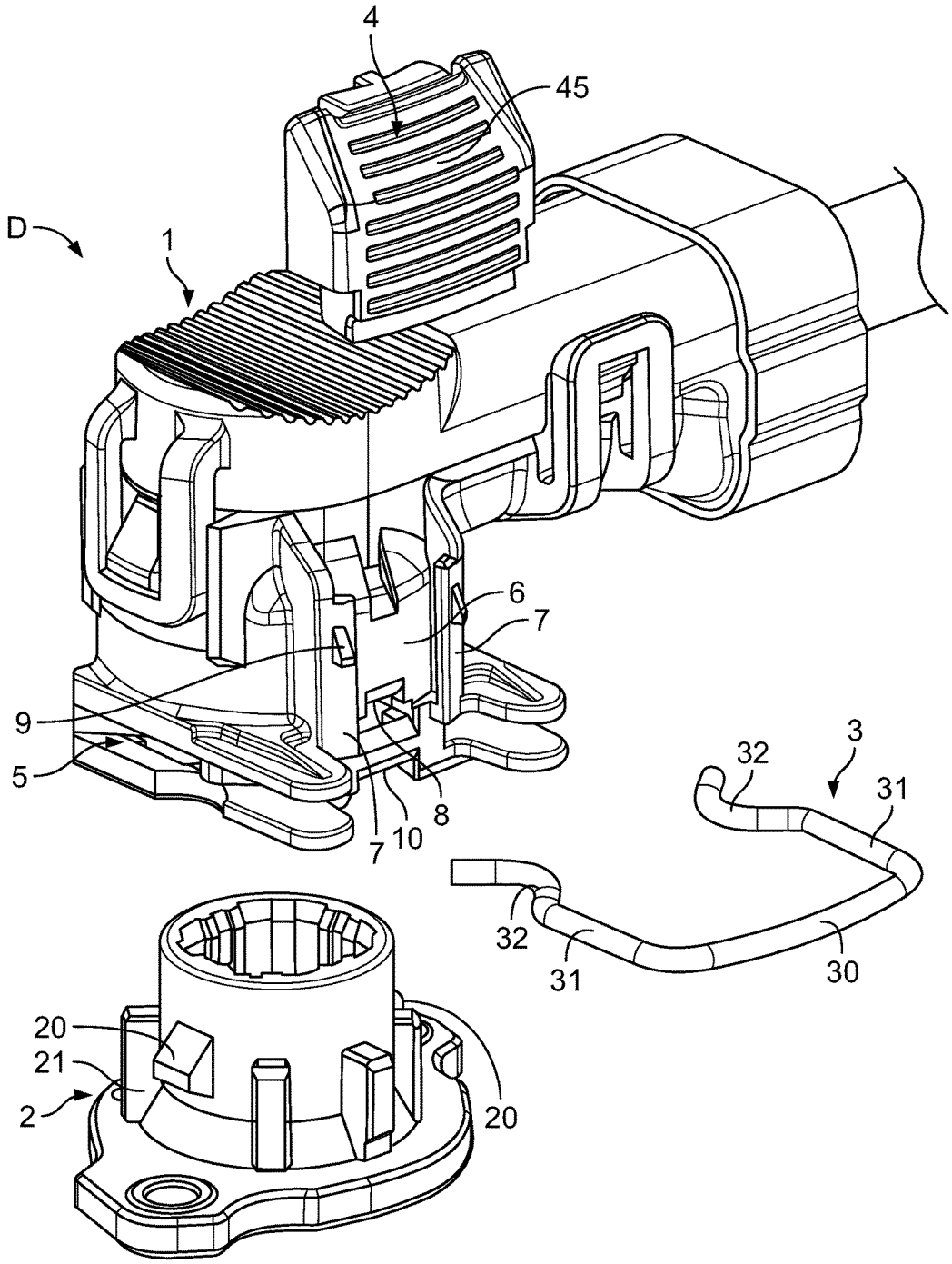
FIG. 1 is an exploded perspective view of an electrical connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An electrical connector D according to an embodiment is shown in FIG. 1. The electrical connector D includes a first connector 1 and a second connector 2. The first connector 1 and the second connector 2 each include a body and a plurality of electrical terminals disposed in the body. In an embodiment, each of the bodies is formed from an insulative plastic material.

The first connector 1 and the second connector 2 are electrically connectable or matable with each other by a mechanical operation carried out by a user. The bodies and electrical terminals of the first connector 1 and the second connector 2 are coupled to one another after the mating of the first connector 1 with the second connector 2. In the embodiment shown in FIG. 1, the first connector 1 is mated with the second connector 2 by pressing the first connector 1 on top of the second connector 2.

The electrical connector D, as shown in FIG. 1, includes an elastic clip 3 and a safety locking member 4. The elastic clip 3 cooperates with the safety locking member 4 when the first connector 1 is connected to the second connector 2.

In the embodiment shown in FIG. 1, the elastic clip 3 and the safety locking member 4 both engage with the first connector 1. The elastic clip 3 is mounted on the first connector 1 at a grooved portion 5 arranged to receive the elastic clip 3. The grooved portion 5 is arranged at the lower part of the connector 1.

The elastic clip 3 is movable between an engagement position, in which the elastic clip 3 is coupled to the second connector 2 to keep it coupled to the first connector 1, and a disengagement position, which enables decoupling of the first connector 1 and the second connector 2. When the first connector 1 is connected to the second connector 2, the elastic clip 3 is coupled to the second connector 2 so as to keep the latter coupled to the first connector 1. The disengagement position and engagement position of the elastic clip 3 are described in greater detail below.

Figure 5:
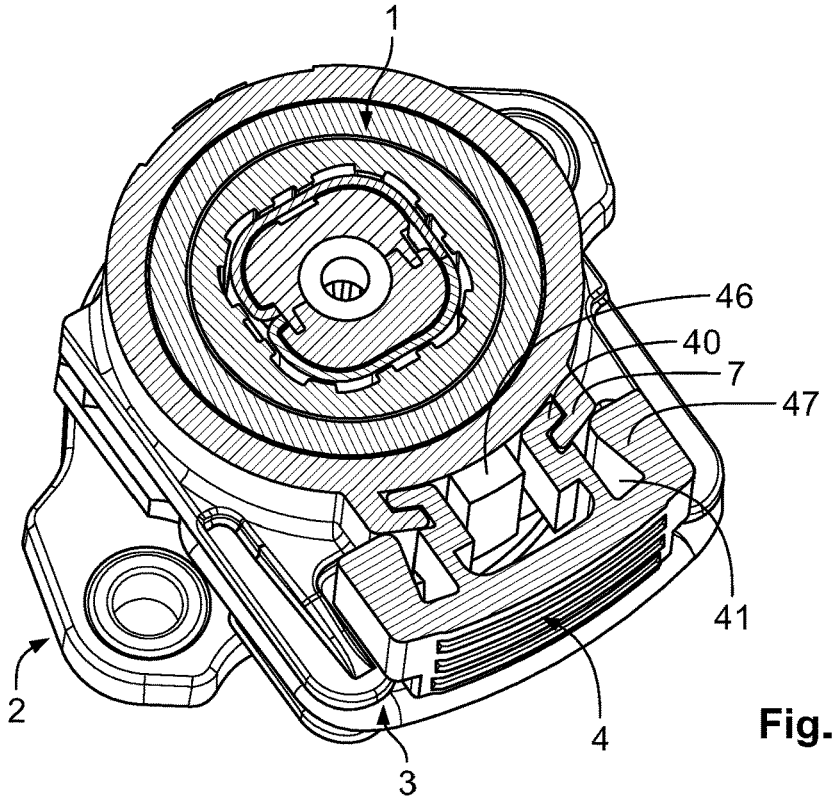
FIG. 5 is a sectional perspective view of the electrical connector.

The safety locking member 4, shown in FIG. 1, is a CPA ("connection position assurance") device, ensuring correct coupling of the first connector 1 to the second connector 2. The safety locking member 4 is mounted slidably on the first connector 1 between a main seat 6, arranged on the body of the first connector device 1 as shown in FIGS. 1 and 5, a matching seat 8, and an end seat 10 arranged to cooperate with the safety locking member 4.

Figure 2:
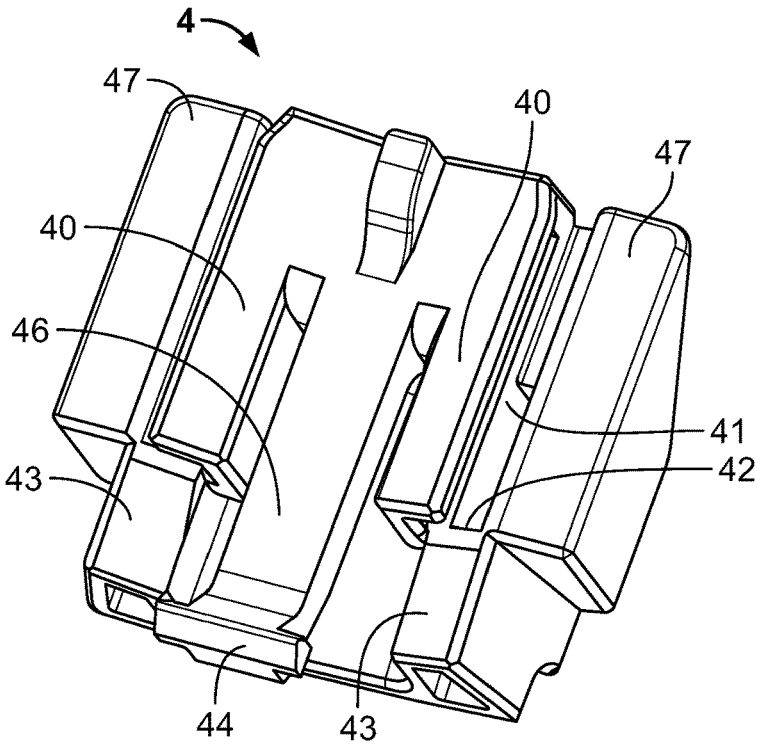
FIG. 2 is a rear perspective view of a safety locking member of the electrical connector.
Figure 3:
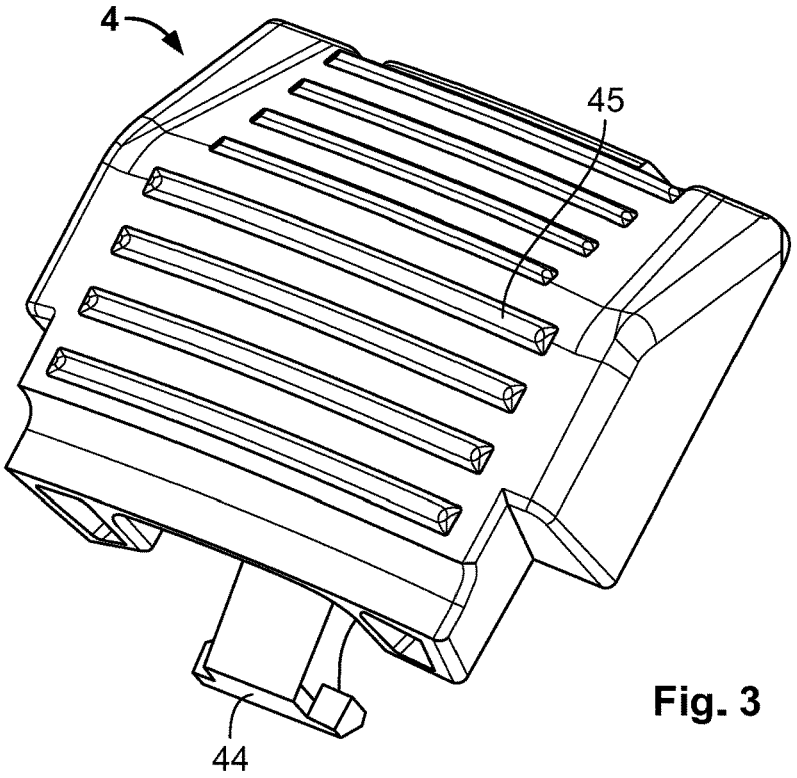
FIG. 3 is a front perspective view of the safety locking member.

As shown in FIGS. 1-3, the safety locking member 4 has a front face 45 intended to be pressed by a user to cause the safety locking member to slide into the main seat 6 so as to move the safety locking member 4 between a pre-locking position and a locking position. The rear face of the safety locking member 4, which comes into contact with the main seat 6 of the first connector 1, has a central elastic arm 46, at the lower end of which an engagement tooth 44 is provided. In the locking position of the safety member 4, the engagement tooth 44 engages the end seat 10 arranged at the lower part of the main seat 6 of the first connector 1.

The safety locking member 4, as shown in FIGS. 1-3, further has two mutually parallel grooved portions 43 defined by respective arms 40 arranged on the sides of the central elastic arm 46. The grooved portions 43 engage respective guide portions 7 of the first connector 1 shown in FIG. 5. The grooved portions 43 each have an associated slit 41; each slit 41 receives an associated inclined tooth 9 arranged on each guide portion 7 of the first connector 1.

Figure 6:
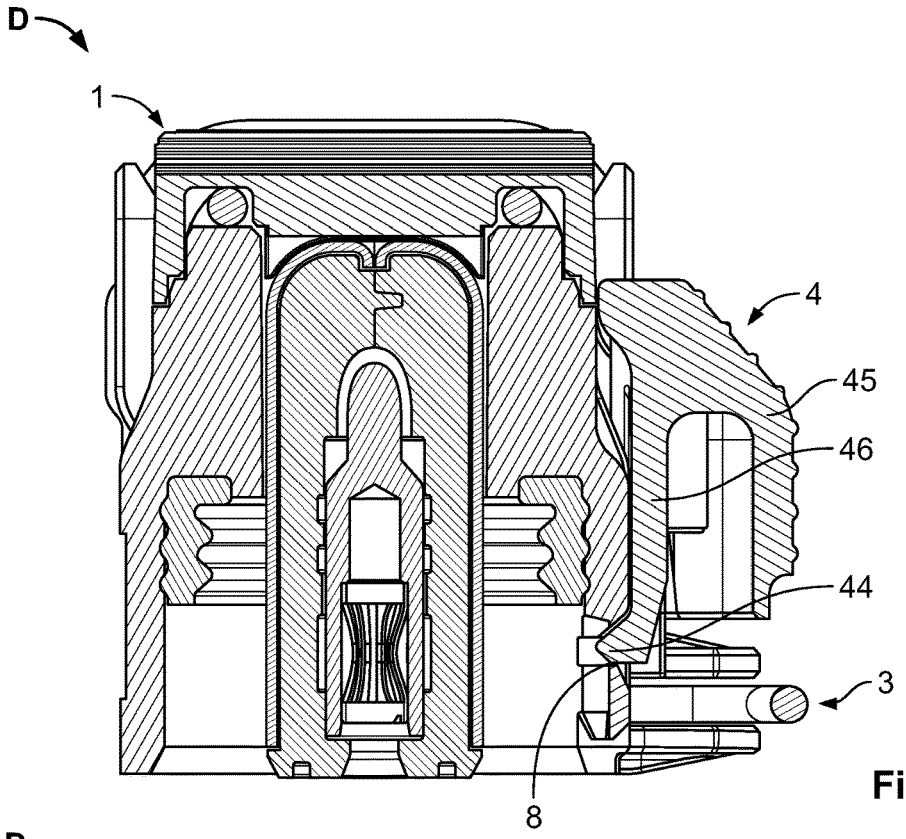
FIG. 6 is a side sectional view of a first connector of the electrical connector with the safety locking member in a pre-locking position.
Figure 7:
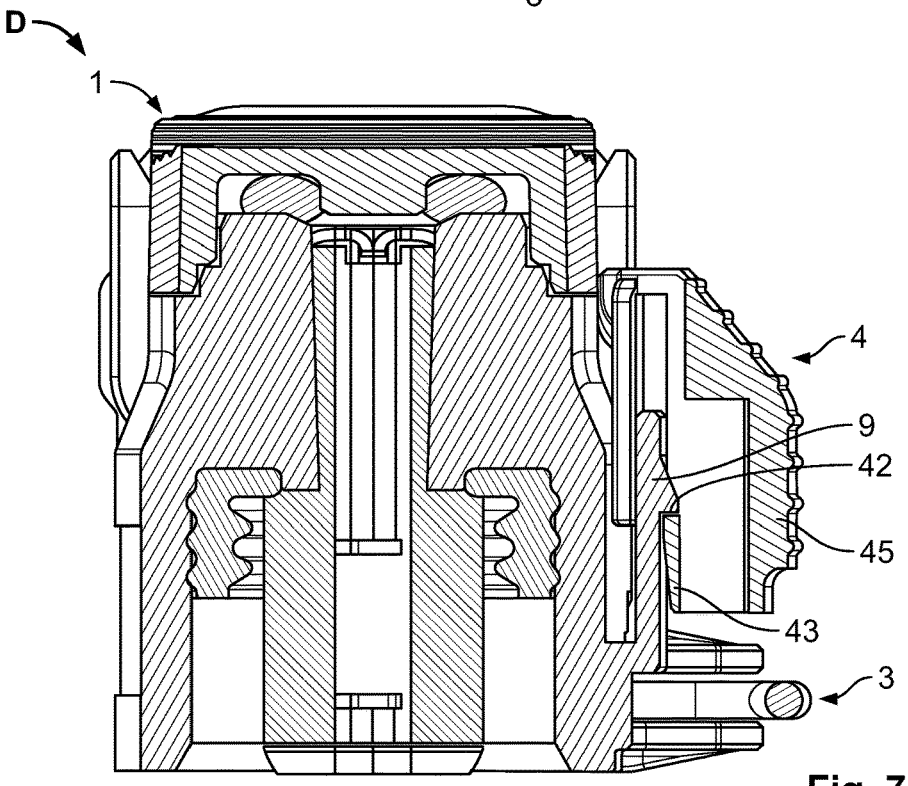
FIG. 7 is a side sectional view of the first connector with the safety locking member in the pre-locking position.

When the first connector 1 is decoupled from the second connector 2, the safety locking member 4 is not displaceable from the pre-locking position to the locking position. In the pre-locking position of the safety locking member 4 shown in FIG. 6, the engagement tooth 44 meshes with the matching seat 8 arranged in the main seat 6 of the first connector 1, and as a result of the shape of the engagement tooth 44 and the matching seat 8, it is not possible to move the safety locking member 4 towards the locking position. As shown in FIG. 7, in the pre-locking position of the safety locking member 4 the inclined teeth 9 mesh with respective matching surfaces 42 provided in the slits 41 of the safety locking member 4. As a result of the meshing between each inclined tooth 9 and the associated matching surface 42, the safety locking member 4 cannot be decoupled from the first connector 1 on which it is slidably mounted.

Figure 8:
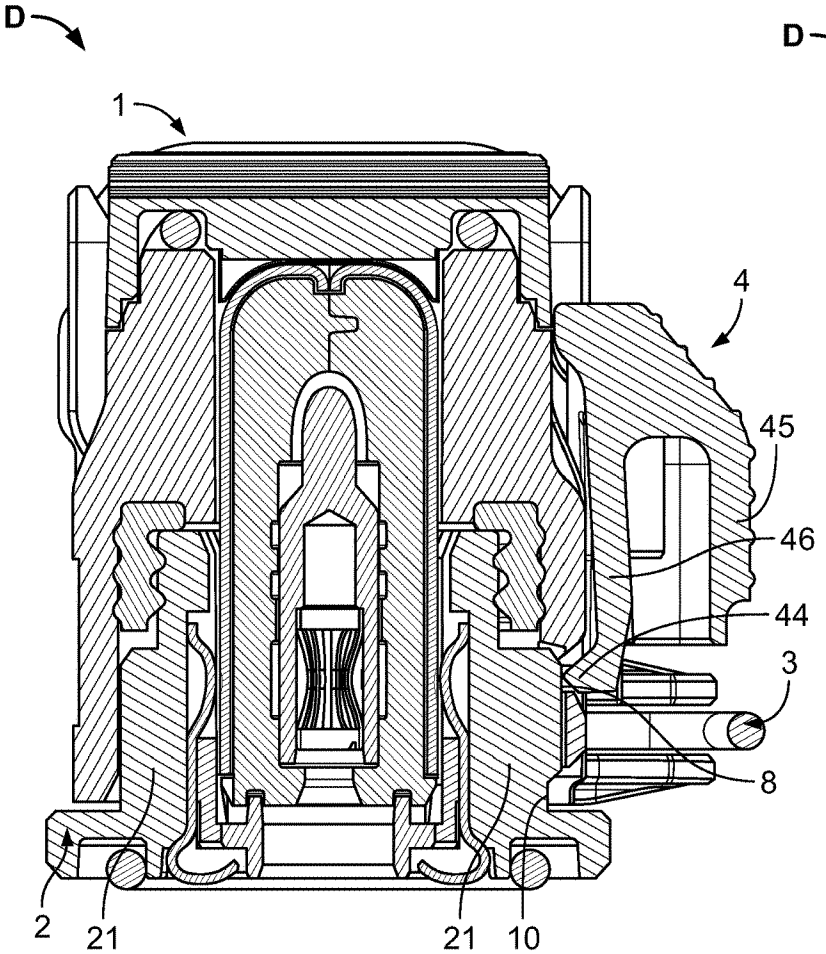
FIG. 8 is a side sectional view of the first connector coupled to a second connector of the electrical connector with the safety locking member in the pre-locking position.

After the coupling of the first connector 1 with the second connector 2, as shown in FIG. 8, a portion 21 of the body of the second connector 2 urges the engagement tooth 44 of the safety locking member 4 into a position removed from the matching seat 8. The safety locking member 4 is then free to be moved by the user from the pre-locking position to the locking position. The locking tooth 44 is received within the end seat 10 of the first connector 1 in the locking position of the safety locking member 4 shown in FIG. 9. As a result, a user who actuates the safety locking member 4, successfully moving it from the pre-locking position to the locking position, is certain that the first connector 1 is correctly coupled to the second connector 2.

The elastic clip 3 mounted in the grooved portion 5 of the first connector 1 is movable between an engagement position and a disengagement position which makes it possible to decouple the first connector 1 and the second connector 2. The elastic clip 3 is coupled to the second connector 2 to keep it coupled to the first connector 1.

Figure 4:
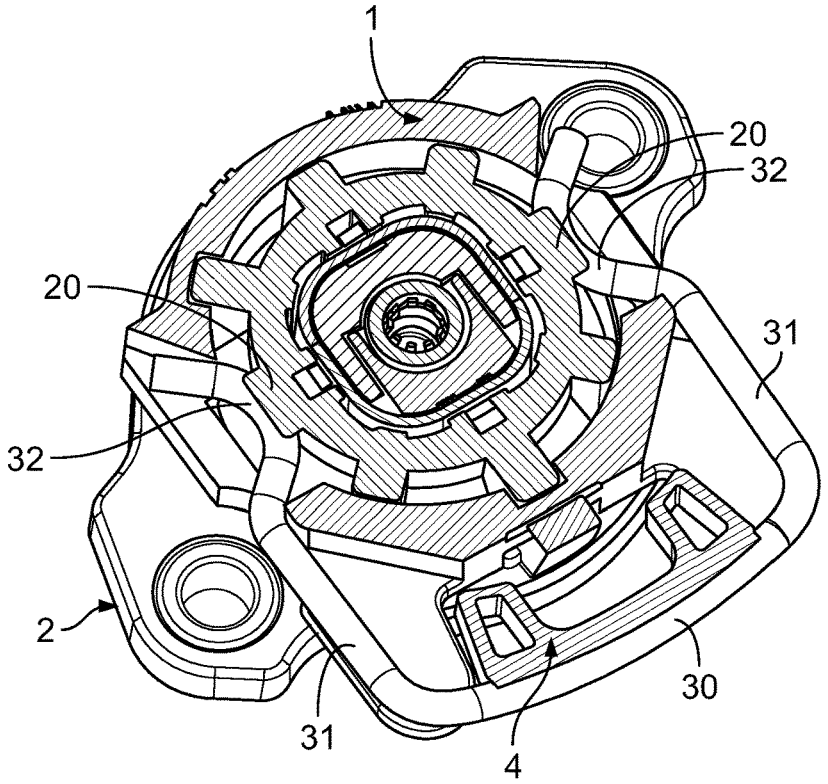
FIG. 4 is a sectional perspective view of the electrical connector.

As shown in FIGS. 1 and 4, the elastic clip 3 is substantially U-shaped and has a central portion 30 and two elastic branches 31. The elastic branches 31 each have an end portion 32; the shape of the elastic branches 31 and of the end portions 32 results in a substantially S-shaped profile. The end portions 32 each cooperate with an associated inclined surface 20 arranged on the outer surface of the second connector 2. The shape of the inclined surfaces 20 and of the end portions 32 of the elastic clip 3 are such that, when the first connector 1 is coupled on top of the second connector 2, the end portions 32 move along the inclined surfaces 20 and the elastic branches 31 spread so that the end portions 32 of the clip 3 are arranged below the inclined surfaces 20, remaining locked.

To decouple the first connector 1 from the second connector 2, it is not sufficient to perform a mechanical operation of pulling the first connector 1, decoupling it from the second connector 2, because the inclined surfaces 20 lock the end portions 32 of the elastic clip 3 and prevent removal of the first connector 1 from the second connector 2. To remove the first connector 1 from the second connector 2, it is necessary to apply a pressing force to the central portion 30 of the elastic clip 3, causing the two end branches 31 to spread, and thus to free the end branches 32 from the inclined surfaces 20 of the second connector 2.

Figure 9:
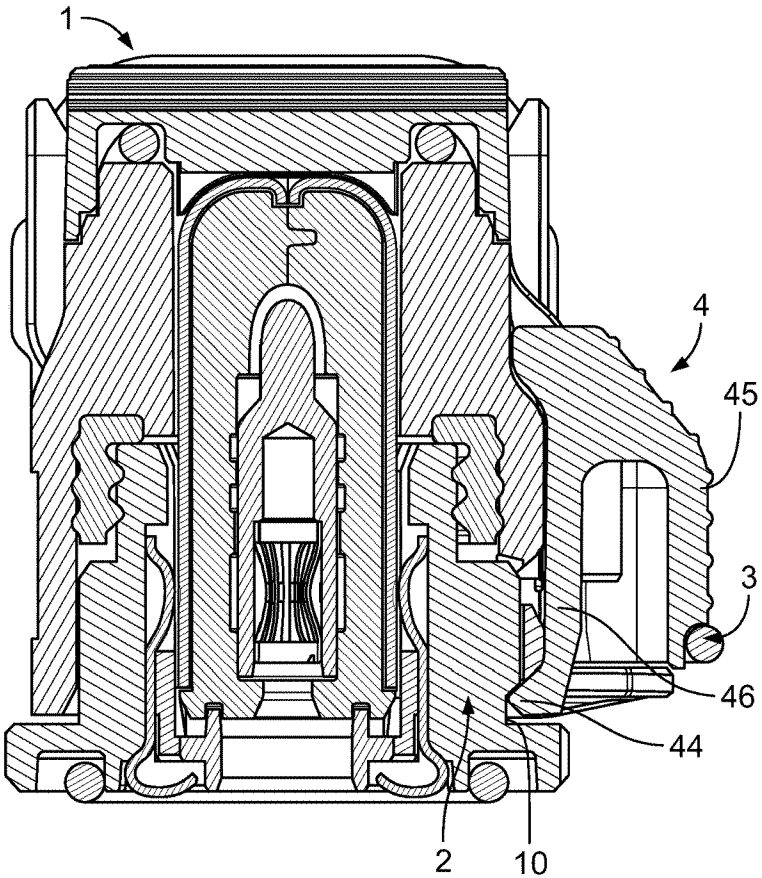
FIG. 9 is a side sectional view of the first connector coupled to the second connector with the safety locking member in a locking position.

The front surface 45 of the safety locking member 4 is in contact with the central portion 30 of the elastic clip 3 as shown in FIG. 9. As a result of the safety locking member 4 being interposed, the elastic clip 3 is not free to be moved into the disengagement position thereof. To decouple the first connector 1 from the second connector 2, it is necessary to move the safety locking member 4 upwards in the orientation of FIG. 9 into the pre-locking position. As shown in FIG. 9, there is no surface or element or structure which prevents the safety locking member 4 from being moved from the locking position to the pre-locking position when the first connector 1 is mated with the second connector 2.

After the displacement of the safety locking member 4 from the locking position to the pre-locking position, the elastic clip 3 can be pressed by the user at the central portion 30 to spread the elastic arms 31 and free the end portions 32 from the inclined surfaces 20 of the second connector 2. After the pressing of the elastic clip 3, it is possible to decouple the first connector 1 and the second connector 2.

The electrical connector D according to the present invention guarantees correct and reliable coupling between the first connector 1 and the second connector 2, so as to be free of operational faults caused by unintended decoupling of the two connectors 1, 2. Further, the structure of the electrical connector D is of a simple construction, is intuitive to use, is low in volume, and is cost-efficient to produce.

What is claimed is:

1. An electrical connector, comprising:

a first connector;

a second connector matable with the first connector;

an elastic clip mounted on the first connector and movable between an engagement position and a disengagement position, the elastic clip is coupled to the second connector in the engagement position to keep the second connector mated with the first connector, and the elastic clip enables decoupling of the first connector and the second connector in the disengagement position, the elastic clip is U-shaped and has a central portion and a pair of elastic branches each having an end portion; and a safety locking member slidably mounted on the first connector and movable between a pre-locking position and a locking position, the safety locking member has a central elastic arm with an engagement tooth, the central elastic arm is disposed on a rear face of the safety locking member opposite a front face of the safety locking member, the front face of the safety locking member contacting the central portion of the elastic clip in the locking position and preventing movement of the elastic clip from the engagement position toward the disengagement position.

2. The electrical connector of claim 1, wherein the first connector and the second connector each include a body and a plurality of electrical terminals disposed in the body.

3. The electrical connector of claim 1, wherein, in the pre-locking position of the safety locking member, the engagement tooth engages in a matching seat of the first connector and prevents movement of the safety locking member from the pre-locking position to the locking position.

4. The electrical connector of claim 1, wherein the first connector has a plurality of guide portions guiding the safety locking member between the pre-locking position and the locking position.

5. The electrical connector of claim 4, wherein the safety locking member has a plurality of grooved portions extending parallel to a longitudinal axis of the safety locking member, the grooved portions engaging the guide portions.

6. The electrical connector of claim 5, wherein each of the grooved portions has a slit receiving an inclined tooth disposed on each of the guide portions.

7. The electrical connector of claim 6, wherein each of the slits has a matching surface engaging with the inclined tooth of one of the guide portions and preventing the safety locking member from being decoupled from the first connector.

8. The electrical connector of claim 3, wherein, when the first connector is mated with the second connector, the second connector moves the engagement tooth out of engagement with the matching seat and the safety locking member is capable of being moved out of the pre-locking position.

9. The electrical connector of claim 8, wherein the end portions of the elastic branches each engage an inclined surface of the second connector in the engagement position.

10. The electrical connector of claim 9, wherein, when a force is applied to the central portion of the elastic clip, the elastic branches spread apart from each other into the disengagement position and are disengaged from the inclined surfaces of the second connector.

11. The electrical connector of claim 10, wherein, when the first connector is mated with the second connector, the safety locking member is disposed between the elastic clip and the second connector.

12. The electrical connector of claim 11, wherein decoupling the first connector from being mated with the second connector requires sliding the safety locking member from the locking position to the pre-locking position and pressing the central portion of the elastic clip to spread the elastic branches apart from each other.

13. An electrical connector, comprising:

a first connector;

a second connector matable with the first connector;

an elastic clip mounted on the first connector and movable between an engagement position and a disengagement position, the elastic clip is coupled to the second connector in the engagement position to keep the second connector mated with the first connector, and the elastic clip enables decoupling of the first connector and the second connector in the disengagement position; and a safety locking member slidably mounted on the first connector and movable between a pre-locking position and a locking position, the safety locking member contacting the elastic clip in the locking position and preventing movement of the elastic clip from the engagement position toward the disengagement position, the first connector has a plurality of guide portions guiding the safety locking member between the pre-locking position and the locking position and the safety locking member has a plurality of grooved portions extending parallel to a longitudinal axis of the safety locking member, the grooved portions engaging the guide portions, each of the grooved portions has a slit receiving an inclined tooth disposed on each of the guide portions.

14. The electrical connector of claim 13, wherein each of the slits has a matching surface engaging with the inclined tooth of one of the guide portions and preventing the safety locking member from being decoupled from the first connector.

15. The electrical connector of claim 13, wherein the safety locking member has a central elastic arm with an engagement tooth.

16. The electrical connector of claim 15, wherein, in the pre-locking position of the safety locking member, the engagement tooth engages in a matching seat of the first connector and prevents movement of the safety locking member from the pre-locking position to the locking position.

17. The electrical connector of claim 16, wherein, when the first connector is mated with the second connector, the second connector moves the engagement tooth out of engagement with the matching seat and the safety locking member is capable of being moved out of the pre-locking position.

18. The electrical connector of claim 17, wherein the elastic clip is U-shaped and has a central portion and a pair of elastic branches each having an end portion.

19. The electrical connector of claim 18, wherein the end portions of the elastic branches each engage an inclined surface of the second connector in the engagement position.

20. The electrical connector of claim 19, wherein, when a force is applied to the central portion of the elastic clip, the elastic branches spread apart from each other into the disengagement position and are disengaged from the inclined surfaces of the second connector.

21. The electrical connector of claim 20, wherein, when the first connector is mated with the second connector, the safety locking member is disposed between the elastic clip and the second connector.

22. The electrical connector of claim 21, wherein decoupling the first connector from being mated with the second connector requires sliding the safety locking member from the locking position to the pre-locking position and pressing the central portion of the elastic clip to spread the elastic branches apart from each other.

* * * * *